US005274582A

United States Patent [19]

Whitby

[11] Patent Number: 5,274,582

[45] Date of Patent: Dec. 28, 1993

[54] ROOT SQUARE SUM CALCULATING APPARATUS

[75] Inventor: Nicholas R. Whitby, Stoke-on-Trent, England

[73] Assignee: Thorn EMI Electronics Limited, Hayes, England

[21] Appl. No.: 724,267

[22] Filed: Jul. 5, 1991

[51] Int. Cl.[5] ..... G06G 7/20

[52] U.S. Cl. ..... 364/814

[58] Field of Search ..... 364/814, 602, 752; 307/498

[56] References Cited

U.S. PATENT DOCUMENTS

| | | | |
|---|---|---|---|
| 3,710,087 | 1/1973 | Siegel | 364/814 |
| 4,511,991 | 4/1985 | Nagano | 364/814 |
| 4,520,300 | 5/1985 | Fradella | 318/603 |

*Primary Examiner*—Long T. Nguyen

*Attorney, Agent, or Firm*—Keck, Mahin & Cate

[57] ABSTRACT

An apparatus for calculating the root square sum of a plurality of values includes a serial commutator for receiving input signals indicative of the values, serially coupled with a root mean square to direct current circuit for providing an output signal indicative of the root square sum of the values. The apparatus may include a plurality of magnetometers for measuring the total value of the magnetic field.

5 Claims, 2 Drawing Sheets

ROOT SQUARE SUM CALCULATING APPARATUS

BACKGROUND OF THE INVENTION

The present invention relates to calculating apparatus and, in particular, to calculating apparatus for calculating the roof square sum of a number of values.

The root square sum of a number of values is required to be calculated in a variety of circumstances. The apparatus for effecting the calculation should be capable of being manufactured relatively easily at low cost whilst providing the required degree of accuracy. Such a calculation is needed, for example, in magnetic measurement when it is required to determine the absolute value of the strength of a magnetic field. The strength of a magnetic field is required in, for example, geometric surveys, detection of ferrous metals or in the evaluation of the field produced by electrical equipment.

For measurement of magnetic fields a sensor is used which comprises of three single axis orthogonally mounted magnetometers. The magnetometers are accurately calibrated to eliminate scaling factors, offset and alignment errors and are, for accurate measurement, of the 'Second-Harmonic Fluxgate' type that yield excellent stability and linearity over a wide dynamic range.

The output signals provided by the magnetometers correspond to orthogonal components of the surrounding magnetic field and the value of the 'total magnetic field' is the root-sum-square of these three components, i.e. the vector sum of the components.

Typically, known circuits for the calculation of the root-sum-square comprises a configuration of analogue multipliers. However, the use of such multipliers has several disadvantages. For example, analogue multipliers of the required performance are relatively expensive and each requires external compensation to account for offsets and gain mismatch. Furthermore, the nature of the algorithm requires a large dynamic range of each multiplier used to square the respective components. In particular, this requirement can result in large errors when the respective field components are small as low level input signals are received by the multipliers which are amplified when the square root function is carried out, the square roof of a small number being a larger number. Additionally, to resolve three magnetic field components requires the use of four analogue multipliers, a high performance operational amplifier, and a large number of discreet passive components. These add to the cost and complexity of the circuit and give rise to a relatively high power consumption level, typically 30 mA for known circuits, which is unacceptable in many applications where it may be required to monitor the total magnetic field over a prolonged period.

SUMMARY OF THE INVENTION

The present invention seeks to provide an improved form of apparatus for calculating the root mean square of a plurality of input values, such as the signals provided by a multiple axis magnetometer in a surrounding magnetic field.

Accordingly, there is provided apparatus for calculating the root square sum of a plurality of values, the apparatus comprising a serial commutator, for receiving input signals indicative of the values, serially coupled with a root mean square to direct current converter circuit for providing an output signal indicative of the root square sum of the values.

Preferably, the apparatus further comprises a clock circuit for clocking the input signals through the serial commutator.

The serial commutator may comprise an analogue switching circuit.

In one form of the apparatus the serial commutator is provided with four input ports for calculating the root square sum of three values, three of the input points being each arranged to receive a signal representing a respective one of the values and the fourth input port being arranged to receive a zero voltage value. In a preferred embodiment, the apparatus comprised a magnetic sensor for measuring the total value of a magnetic field and including a plurality of single axis magnetometers for providing the input signals to the serial commutator.

There is also provided a method for calculating the roof sum square of a plurality of values comprising time multiplexing a plurality of signals representing the plurality of values and affording the time multiplexed signals to a roof means square to direct current converter.

BRIEF DESCRIPTION OF THE DRAWINGS

The present invention will now be described, by way of example only, with reference to the accompanying drawings in which.

DETAILED DESCRIPTION OF A PREFERRED EMBODIMENT

Figure 1:
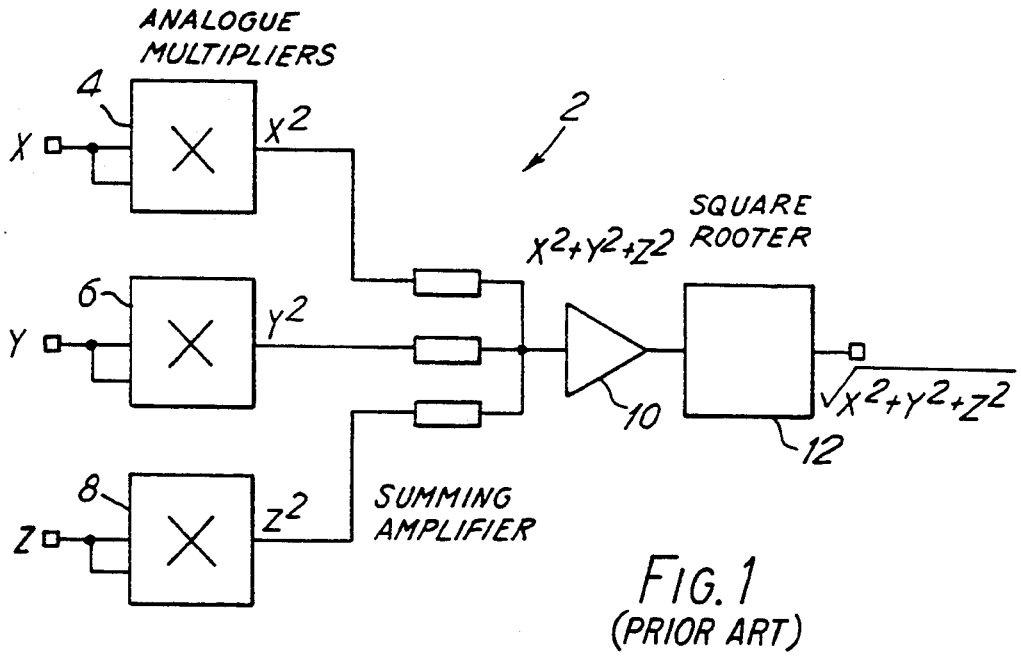
FIG. 1 (PRIOR ART)
FIG. 1 shows a schematic block diagram of a known not sum square computation circuit.

Referring to FIG. 1, a known circuit 2 for calculating the root square sum (RSS) of a number of values, three in the example shown and designated as x, y and z, comprises three analogue multipliers 4, 6, 8 arranged to receive the values x, y and z, which may, typically, represent three orthogonal components of a magnetic field for which the 'Total Field' is required lobe calculated, the total field being given by the expression $(x^2+y^2+z^2)^{\frac{1}{2}}$. The multipliers 4, 6, 8 provide output signals equal, respectively, to $x^2$, $y^2$ and $z^2$ which, after compensations to account for offset and gain mismatch of the multipliers are fed to a summing amplifier. The output from the summing amplifier 10, equal to $x^2+y^2+z^2$, is fed to a square-root circuit 12, thereby to provide the required output signal which is indicative of the 'Total Magnetic Field'.

However, as previously stated, the circuit 2 suffers from many disadvantages, in particular the cost of an analogue range required from the multipliers 4, 6, 8, as the terms $x^2$, $y^2$ and $z^2$ are derived before the summing and square root functions take place.

Figure 2:
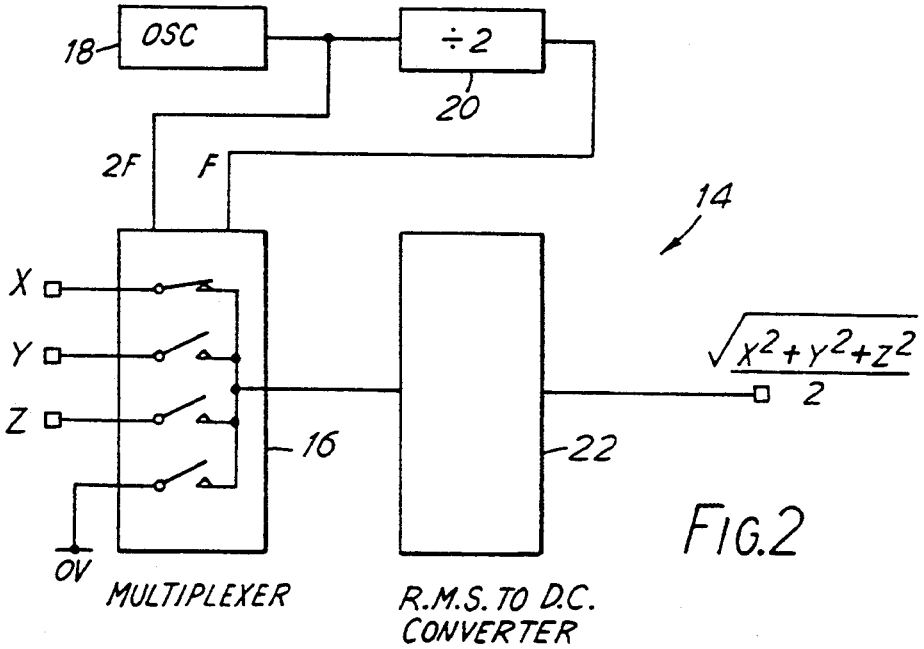
FIG. 2 shows a schematic block diagram of a root sum square computation circuit according to the present invention.

FIG. 2 shows an embodiment of a circuit 14 according to the present invention for calculating the roof square sum of a number of values, also termed as x, y and z. The circuit 14 comprises a multiplexer, in the form of a serial commutator 16 such as an analogue switch, having a plurality of input ports for receiving the values x, y and z, which may be provided by three orthogonally disposed single axis magnetometers of a sensor for measuring the absolute field strength of a magnetic field.

The commutator 16 is provided with four input ports or channels, the fourth channel being arranged to receive a voltage of OV so as to simplify circuit operation. The circuit 14 includes on oscillator 18 and a divider circuit 20 for generating clock pulses of frequencies F and 2F. The pole or output of the commutator 16 is coupled to a root mean square to direct current (RMS to DC) converter circuit 22, the output signal of which is indicative of the required total magnetic field.

Figure 4:
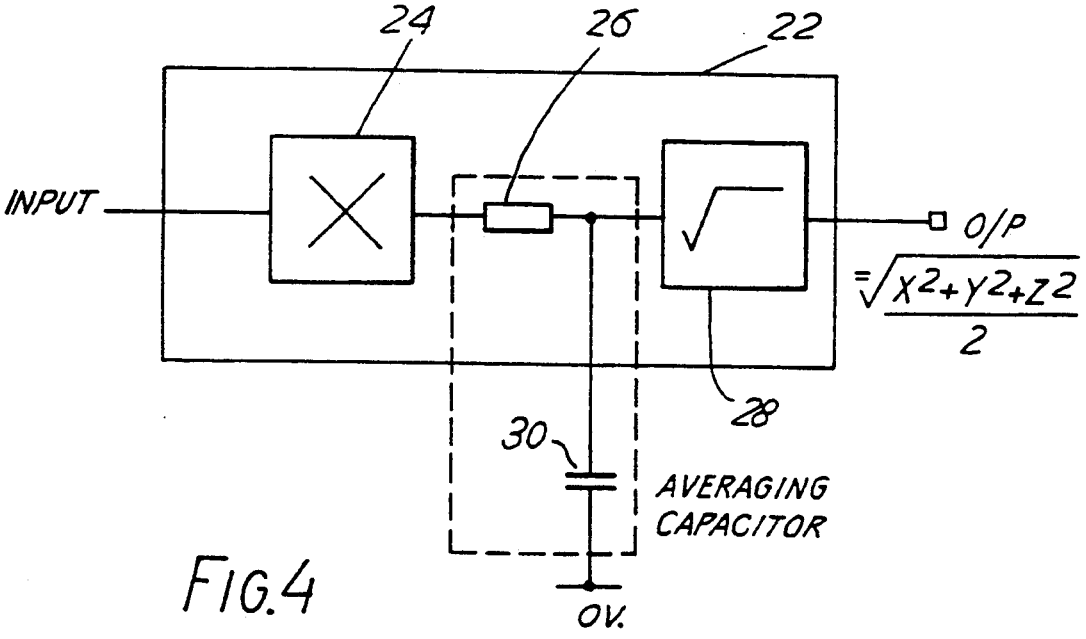
FIG. 4 is a schematic diagram of the root mean square to direct current converter circuit of the arrangement shown in FIG. 2.

The RMS to DC converter circuit 22 is shown in greater detail in FIG. 4 and can be considered as having three separate stages, namely a squarer circuit 24, an averaging circuit 26 in the form of a low pass filter, and a square root circuit 28.

Figure 3:
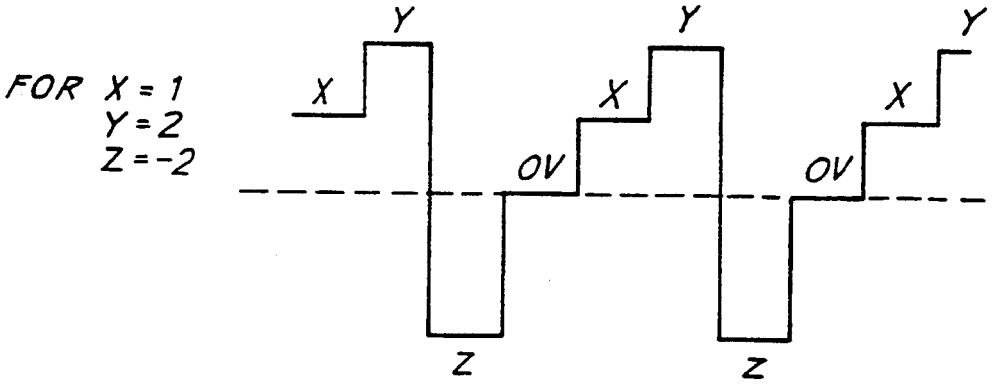
FIG. 3 shows a typical output signal from the serial commutator of the circuit illustrated in FIG. 2.

In operation, the application of the values x, y and z to three respective channels or input ports of the commutator 16 and a zero voltage to the fourth input, provides an output waveform of the form shown in FIG. 3, with the values x, y and z multiplexed in time with the zero voltage input. Provided that the switching times of the channels are matched, the waveform of FIG. 3 contains equally weighted components of the values x, y and z, and the zero voltage input.

The waveform shown in FIG. 3 is input to the RMS to DC converter 22 where the squarer circuit provides a signal which is of similar form to that shown in FIG. 3 but in which the individual components corresponding to $x^2$, $y^2$ and $z^2$. For most accurate results the converter 22 would utilise an 'Implicit' solution whereby the RMS output is fed back along a feedback path into the squarer circuit 24 to compensate for any dynamic range problems manifest by the squarer circuit.

The low pass filter 26 yields the DC average of the time multiplex $x^2$, $y^2$, $z^2$ signal produced by the squarer circuit 24 provided that the time constant of the filter 26, as is determined by the value of a capacitor 30, is large with respect to the multiplexing frequency provided by the oscillator 18. The level of the voltage afforded to the square root circuit 28 is, therefore, in the example shown with four inputs, $$\frac{x^2 + y^2 + z^2 + o^2}{4}$$

The square root circuit 24 will, therefore, provide an output signal equal to $$\frac{x^2 + y^2 + z^2}{2},$$

which is equal to $$\frac{RSS}{2}$$

This signal can be used to indicate the total magnetic field.

In general, any number of input ports or channels may be provided for the commutator 16. Hence, if the circuit was expanded to provide the RSS of n values, the output signal would be $$\frac{RSS}{n^{\frac{1}{2}}}$$

For the detection of total magnetic field, a three axis magnetometer is usually used, providing three input values. The use in the embodiment of FIG. 2 of a fourth channel coupled to zero volts simplifies the clock control circuitry to the commutator 16, is enabling in the arrangement shown, a simple two-bit binary clock to be used.

Certain parameters of the circuit may be varied, such as the value of the capacitor 30 for the RMS to DC converter and the frequency used to time multiplex the inputs to the commutator 16. It is important that the multiplexing frequency of the commutator 16 is high compared to the time constant of the averaging circuit 26. In a typical arrangement, the multiplexing frequency may be 20KHz whilst the value of capacitor 30 is chosen to provide a time constant of about 15 msec.

It should be appreciated that the circuit may be expanded to compute the root-sum-square of any number of values by adding an appropriate number of channels in the commutator 16, together with the necessary control timing. An important consideration, to keep errors to a minimum, is that the "ON" time for each channel should be the same for each input.

The RMS to DC converter 22 is, preferably, of integrated circuit (IC) form and the accuracy of the computation is dependent on the accuracy of the converter chip and the matching of the 'ON' times for the channels of the commutator 16.

The apparatus has many advantages over existing circuits for RSS calculation. The apparatus can be manufactured at relatively low cost as only one precision IC is required which, currently, is approximately half the cost of a single analogue multiplier used in known circuits. Furthermore, the apparatus contains few external components, providing ease of manufacture. Additionally, the apparatus exhibits high accuracy as the arrangement does not requite the dynamic range of the known circuit and does not suffer from the calibration errors of the prior system.

Moreover, the apparatus exhibits low power consumption, typically 2 milliamps. Also, the apparatus can easily be configured to perform the root-sum-square of a larger number of inputs merely by the provision of an appropriate number of channels in the commutator 16 and associated control circuitry, a further RMS to DC converter circuit not being required.

Although the present invention has been described with respect to a specific embodiment, it should be realised that modifications may be effected whilst remaining within the scope of the invention. Furthermore, it is stressed that the invention is intended to cover magnetic field sensors incorporating calculating apparatus operating on the principles as described.

I claim:

1. An apparatus for calculating a root square sum of a plurality of values, the apparatus comprising a serial commutator, for receiving input signals indicative of the values, serially coupled with a root mean square to direct current converter circuit for providing an output signal indicative of the root square sum of the values.

2. An apparatus as claimed in claim 1, further comprising a clock circuit for clocking the input signals through the serial commutator.

3. An apparatus as claimed in claim 1, wherein the serial commutator is an analogue switching circuit.

4. An apparatus as claimed in claim 1, wherein the serial commutator is provided with four input ports for calculating the root square sum of three values, three of the input ports being each arranged to receive a signal representing a respective one of the values and the fourth input port being arranged to receive a zero voltage value.

5. An apparatus as claimed in claim 1, further comprising a magnetic sensor for measuring the total value of a magnetic field, and a plurality of single axis magnetometers for providing the input signals to the serial commutator.

* * * * *